United States Patent [19]

Takashima

[11] Patent Number: 4,596,524

[45] Date of Patent: Jun. 24, 1986

[54] LIQUID FUEL BURNING APPARATUS

[75] Inventor: Tadashi Takashima, Nara, Japan

[73] Assignee: Matsushita Electric Industrial Co. Ltd., Osaka, Japan

[21] Appl. No.: 619,464

[22] PCT Filed: Oct. 13, 1983

[86] PCT No.: PCT/JP83/00344

§ 371 Date: Jun. 8, 1984

§ 102(e) Date: Jun. 8, 1984

[87] PCT Pub. No.: WO84/01612

PCT Pub. Date: Apr. 26, 1984

[30] Foreign Application Priority Data

Oct. 15, 1982 [JP] Japan ..... 57-181726
Oct. 15, 1982 [JP] Japan ..... 57-181727

[51] Int. Cl.[4] ..... F23N 5/24

[52] U.S. Cl. ..... 431/88; 431/304; 431/317; 431/33; 126/96

[58] Field of Search ..... 431/33, 88, 301, 304, 431/307, 315, 316, 317; 126/95, 96

[56] References Cited

FOREIGN PATENT DOCUMENTS 413014 2/1956 Japan .
0137736 10/1979 Japan ..... 431/301
0052709 3/1982 Japan ..... 431/88
57-55085 11/1982 Japan .
1461735 1/1977 United Kingdom .

*Primary Examiner*—Margaret A. Focarino
*Attorney, Agent, or Firm*—Wenderoth, Lind & Ponack

[57] ABSTRACT

This invention provides a wick type burner equipped with a manual fire extinguishing means for pushing up a lever (37) through an intermediary of a pin (43) by the operation of a manual fire extinguisher (41), thereby disengaging it from the first locking part (33*a*), to permit the wick (24) to go down until it engages with the second locking part (33*b*) and a quake fire extinguishing means for pushing up the lever (37) by means of the flange (39*a*) as the weight (39) has fallen down, causing the wick (24) to go down deeper without encountering the first locking part (33*a*) and the second locking part (33*b*), so that while the safety is assured by effecting fire extinguishment in short time in an emergency as when an earthquake occurs, etc., in normal fire extinguishment, the flame is once diminished merely by operating the manual fire extinguisher (41) and the fire extinguishment is made after maintaining this state for 90–200 seconds, thereby remarkably reducing the odor at the time of fire extinguishment for improved comfort.

6 Claims, 12 Drawing Figures

LIQUID FUEL BURNING APPARATUS

TECHNICAL FIELD

This invention relates to a liquid fuel burning apparatus designed to minimize the bad odor given off during normal fire extinguishment by differentiating the amounts of lowering of the wick brought about by normal fire extinguishing means and by emergency quake fire extingushing means.

TECHNICAL BACKGROUND

Generally this type of liquid fuel burning apparatus is provided with a lowering device for detecting vibrations such as earthquakes during combustion and automatically lowers the combustion wick to extinguish the fire. This type of apparatus is designed so that when the wick is manually lowered, the lowering stroke is shortened to eliminate the bad odor given off during fire extinguishment. This is shown in FIGS. 1 through 4. In these figures, the numeral 1 denotes an oil tank having a burner section 2 on its top.

The numeral 3 denotes a wick vertically slidably installed in the burner section 2 and constantly urged in the lowering direction by a spring (not shown).

The numeral 4 denotes a wick shaft rotatably mounted on the apparatus, having attached thereto at one end a pinion 5' meshing with a rack 5 fixed to the wick 3 and at the other end a knob 6 for the wick shaft 4, the arrangement being such that the rotation of the knob vertically moves the wick 3.

The numeral 7 denotes a support fixed to the wick shaft 4 by a screw 8, and 9 denotes a rotary plate fixed to the support 7 and having a pin 10 fixed to the upper portion thereof.

The numeral 11 denotes a ratchet wheel rotatably mounted on the support 7 and formed around its outer periphery with a projection **11*a* and a plurality of teeth 11*b*, said ratchet wheel 11 having a throughgoing slot 11*c* in which said pin 10** slides.

The numeral 12 denotes friction members fixed to the opposite surfaces of the ratchet wheel 11 and urged by friction members 13 in the form of spring sheets.

The spring members 13 are held in position on the support 7 by restraint members 14.

The numeral 15 denotes a vibration sensing device attached to the top of the oil tank 1 and comprising a weight 16 and a lever 17 operable by said weight 16, said lever 17 being formed at its front end with a locking device 18 for the wick 3.

The locking device 18 comprises the lever 17, an auxiliary lever 19 mounted on the front end of said lever 17, and a spring 20 for urging said auxiliary lever 19 to the ratchet wheel 11.

The front end of said auxiliary lever 19 is formed with a locking portion **19*a* adapted to mesh with the teeth 11*b* formed on the ratchet wheel 11, the engagement between said locking portion 19*a* and the teeth 11*b* preventing reverse rotation (counterclockwise rotation, in the figure) of the ratchet wheel 11**.

Further, the front end of said lever 17 is formed with a stop **17*a* adapted to abut against the projection 11*a* on the ratchet wheel 11 to stop rotation of the ratchet wheel 11. In addition, the optimum burning position for kerosene fuel sucked up by the wick 3 is so designed that it corresponds to the height (point a in FIG. 4) of the wick 3 obtained when, as shown in FIG. 2, the stop 17*a* on the lever 17 abuts against the projection 11*a* on the ratchet wheel 11 and the pin 10 fixed to the rotary plate 9 abuts against the terminal end of the throughgoing slot 11*c* formed in the ratchet wheel 11**.

Further, the lever 17 and auxiliary lever 19 of said locking device 18 are adapted to move in the direction of arrow A in FIG. 2 when the vibration sensing device 15 is actuated, thereby canceling the locking between the ratchet wheel 11 and the locking device 18.

The numeral 21 denotes an emergency fire extinguishing device so designed that a knob **21*a* is rotated separately from the vibration sensing device 15 to move the lever 17 which is connected to the knob 21*a* with a chain, etc., in the direction of arrow A in FIG. 2, thereby canceling the locking between the locking device 18 and the ratchet wheel 11**.

In addition, 22 denotes an inner wick cylinder and 23 an outer wick cylinder.

In such apparatus, when it is desired to decrease the height of the wick 3, the knob 6 is rotated counterclockwise. Then, although the ratchet wheel 11 is locked by the locking device 18 and cannot be rotated, the knob 6 is rotated by overcoming the frictional force of the friction members 12 and 13 and lowers the wick 3. Further, in the normal fire extinguishment, the knob 6 is rotated counterclockwise until the pin 10 fixed to the rotary plate 9 abuts against the other terminal end of the throughgoing hole **11*c* formed in the ratchet wheel 11, as shown in broken lines in FIG. 2 (the angle of rotation of the knob being about 300° in the figure), thus lowering the wick 3 to point b in FIG. 4**.

If a vibration such as caused by an earthquake is applied to this kerosene burning apparatus, the weight 16 of the vibration sensing device 15 senses this situation and moves the lever 17 in the direction of arrow A in FIG. 2. Then, since the ratchet wheel 11 is released from the locking device 18, the urging force of the loaded spring (not shown), which has a downward force, quickly lowers the wick 3, thus instantly extinguishing the fire on the wick 3. Further, when it is necessary to extinguish this kerosene fuel burning apparatus in an emergency for a reason other than a vibration such as caused by an earthquake, the knob **21*a* is rotated to move the lever 17 in the direction of arrow A in FIG. 2, whereby the fire can be instantly extinguished in the same manner as described above. In the case of the emergency fire extinguishment described above, the ratchet wheel 11 is released from the locking device 18. When the ratchet wheel 11 is released from the restricted position imposed by the locking device 18, the wick 3 which has been indirectly restricted in position by the ratchet wheel 11 is released from the positional control imposed by the ratchet wheel. Therefore, the wick 3 is rapidly lowered to point c in FIG. 4** by the spring (not shown) which has stored force in the lowering direction.

In addition, the positions of the wick 3 for normal fire extinguishment and for emergency fire extinguishment differ from each other, as indicated at points b and c. The reason for this difference is as follows: In the case of normal fire extinguishment, since the rotation of the pin 10 on the rotary plate 9 is restricted by the throughgoing hole **11*c* of the ratchet wheel 11, the wick 3, whose upper and lower positions are associated with the rotation of the rotary plate 9, is naturally restricted in position by the terminal end of the throughgoing hole 11*c*; on the other hand, in the case of emergency fire extinguishment, the ratchet wheel 11 is also rotated along with the wick shaft 4 and the lowered position of the wick 3 is not restricted by the throughgoing hole 11 of the ratchet wheel 11** and, therefore, the wick will go down to the point c, the lowermost position.

However, such apparatus is cumbersome since the knob 6 must be rotated manually during normal fire extinguishment.

On the other hand, there is an arrangement intended to avoid such cumbersomeness and adapted to be operatively connected to the vibration sensing device even when normal fire extinguishment is to be effected so that the fire can be put out instantly. In such apparatus, however, since the fire is put out in as short a time in normal fire extinguishment as in an emergency, the liquid fuel vapor being produced in the high temperature wick guide cylinder flows into the combustion cylinder which is still hot, where the vapor is thermally decomposed to produce aldehyde or the like whose smell makes the user feel unpleasant.

DISCLOSURE OF THE INVENTION

This invention provides an arrangement enabling the wick to be automatically lowered during normal fire extinguishment in the same manner as when the vibration sensing device is actuated, wherein during normal fire extinguishment a first locking section is released and the wick is lowered until it is locked by a second locking section, while when the quake fire extinguishing means is actuated, the first and second locking sections are both released to allow the wick to descend, so that the amount of lowering of the wick during normal fire extinguishment is smaller than the amount of lowering thereof due to actuation of the quake fire extinguishing means, thereby minimizing the odor given off during normal fire extinguishment so as to increase pleasantness.

BEST MODE OF CARRYING OUT THE INVENTION

Figure 1:
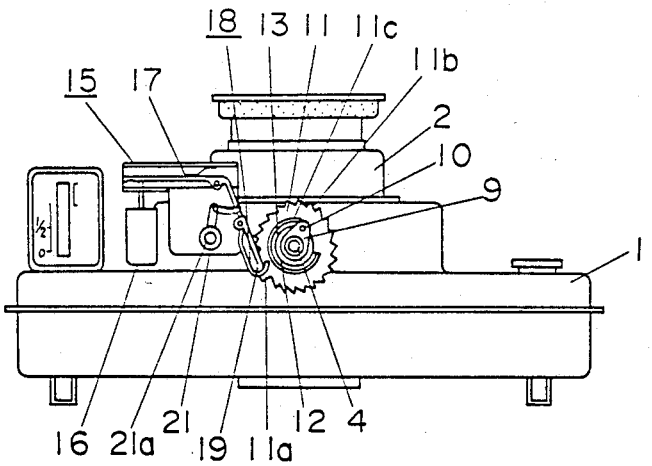
FIG. 1 PRIOR ART
FIG. 1 is a front view of a conventional kerosene burning apparatus.
Figure 2:
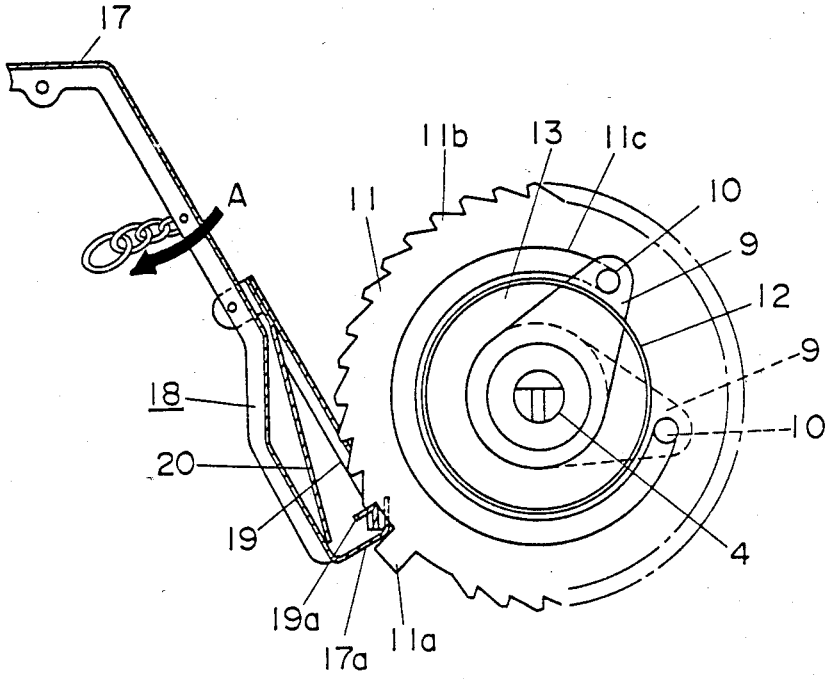
FIG. 2 PRIOR ART
FIG. 2 is a front view showing the principal portion of said apparatus.
Figure 3:
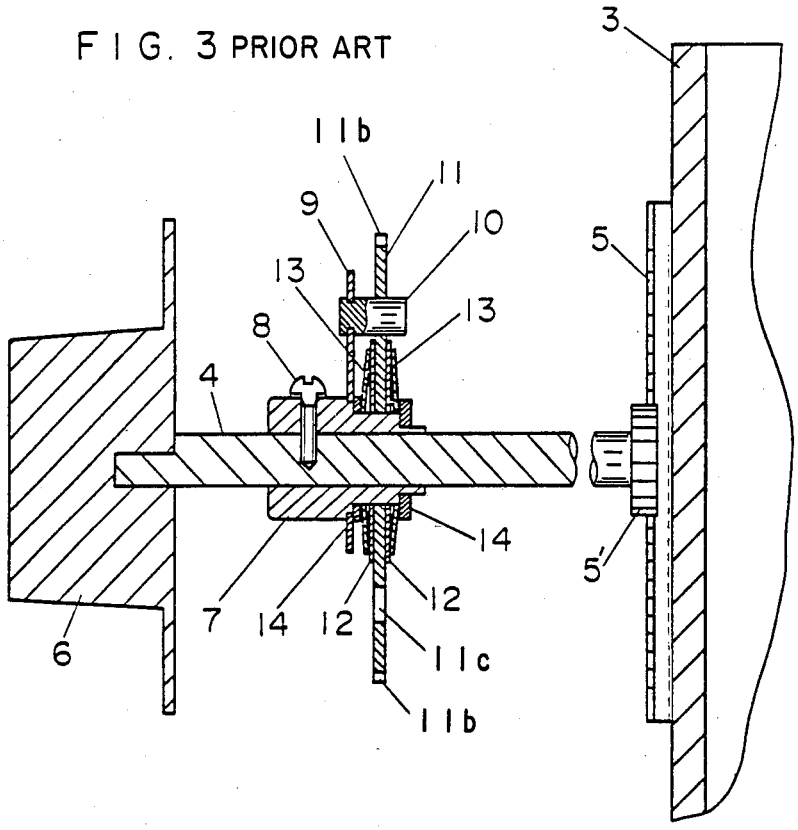
FIG. 3 PRIOR ART
FIG. 3 is a side view of the principal portion of said apparatus.
Figure 4:
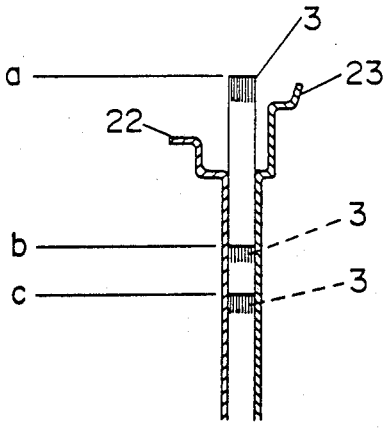
FIG. 4 PRIOR ART
FIG. 4 is a fragmentary view of said apparatus.
Figure 5:
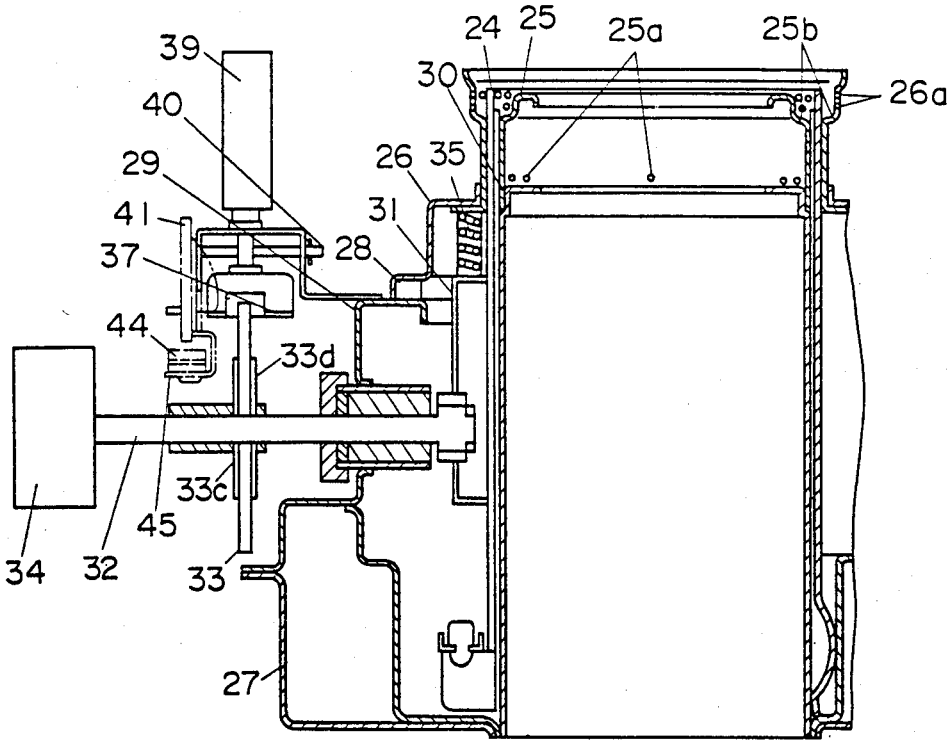
FIG. 5 is a side sectional view of the principal portion, showing the normal combustion state of a liquid fuel burning apparatus according to an embodiment of the present invention.
Figure 6:
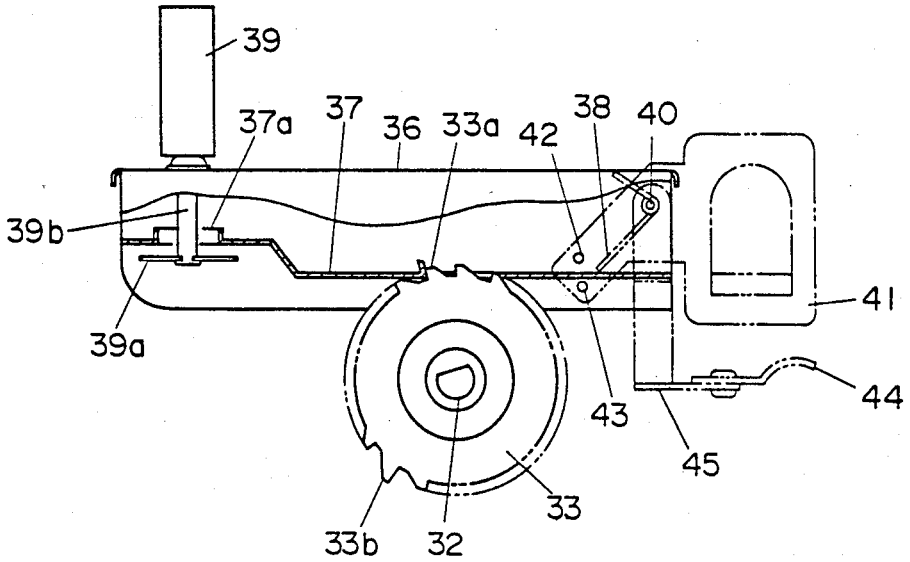
FIG. 6 is a front sectional view of the principal portion of said apparatus.

In FIGS. 5 and 6, the numeral 24 denotes a cylindrical wick internally and externally provided with a wick guide cylinder 25 and an outer wick guide cylinder 26, forming a wick receiving section, the wick guide cylinder 25 being formed in its upper portion with small holes 25*a* for accelerating fire extinguishment. These small holes may be formed in the outer wick guide cylinder 26 instead of in the wick guide cylinder 25. The wick guide cylinder 25 is fixed to a lower tank 27 and the outer wick guide cylinder 26 is fixed to an upper tank 29 through a packing 28, the upper and lower tanks 29 and 27 being welded together. The wick 24 is internally provided with a cylindrical wick fixing metal attachment 30 fixed thereto by paste and by claws, and a wick lifting metal attachment 31 having a rack section is welded to said wick fixing metal attachment 30 through a portion of the wick 24. A wick lifting shaft 32 having a pinion section abutting thereagainst extends through the front of the upper tank 29. A fire extinguishing gear wheel 33 has normal teeth 33*a* and a higher tooth 33*b* and is put on and fixed to the wick lifting shaft 32 and held between friction members 33*c* and 33*d*. A knob 34 is fitted on the front end of said shaft 32. The numeral 35 denotes a coiled fire extinguishing spring fixed at its lower end to the wick lifting metal attachment 31 and abutting at its upper end against the flat portion of the outer wick guide cylinder 26, thereby downwardly urging the wick 24 through the intermediary of the wick lifting metal attachment 31. Numeral 36 denotes a quake actuated fire extinguishing (QFE) device comprising a lever 37 for engaging with the normal teeth 33*a* and the higher tooth 33*b*, a torsion spring 38 which urges the aforementioned lever 37 toward the fire extinguisher (FE) gear 33 side, and the weight 39 which is set to release the engagement of the aforementioned lever 37 both with the normal teeth 33*a* and the higher tooth 33*b*, when shaken by a tremor. The aforementioned lever 37 is constructed to be urged at its one end side toward the FE gear 33 side, while having its central opening abutted on the normal teeth 33*a* or the higher tooth 33*b* of the FE gear 33. The aforementioned torsion spring 38 is mounted on the QFE device 36 through a shaft 40. The weight 39 has a flange 39*a* on a connection 39*b*, the connection 39*b* being passed through an aperture formed in the QFE device 36 and an aperture 37*a* in the lever 37 with a larger diameter than that of the connection 39*b*, and the weight 39 being located above the QFE device 36, and the flange 39*a* below the aperture 37*a*. The manual FE 41 is rotatably mounted on the QFE device 36 through the shaft 40 and attached with pins 42 and 43 which are located above and below the lever 37. The pin 42 which will serve to reset the QFE device 36 after it has been actuated by a downward movement of the weight 39, will urge the lever 37 downward as the manual FE 41 is pushed up, while the pin 43 is adapted to urge the lever 37 upward as the manual FE 41 is pushed down for releasing the engagement of the lever 37 with the normal teeth 33*a* or the higher tooth 33*b*. Numeral 44 designates a spring plate, which is so located as to be abutted on by the manual FE 41 only when the engagement between the lever 37 and the higher tooth 33*b* is released by depressing it, and which is held at its one end on a spring supporting fixture 45 secured in place by welding, etc. In the aforesaid arrangement, the operation and function thereof will now be described. For ignition, the knob 34 is rotated clockwise through slightly less than one revolution, and one of the normal teeth 33*a* engages with the lever 37, as shown in FIGS. 5 and 6. In this state, as the wick 24 is ignited, combustion is set about with air coming from the small holes 26a of the outer wick guide cylinder 26; thus, normal combustion takes place in the combustion cylinder (not shown) mounted on the outer wick guide cylinders 26 and the wick guide cylinder 25.

Figure 7:
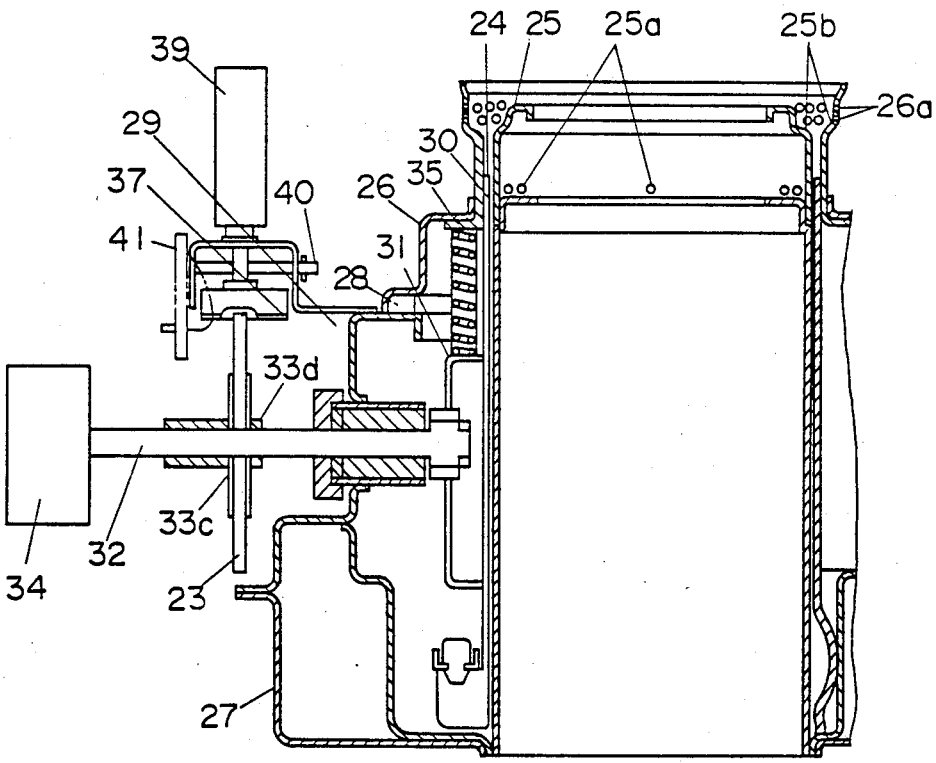
FIG. 7 is a side sectional view of the principal portion, showing the normal fire extinguishing state.
Figure 8:
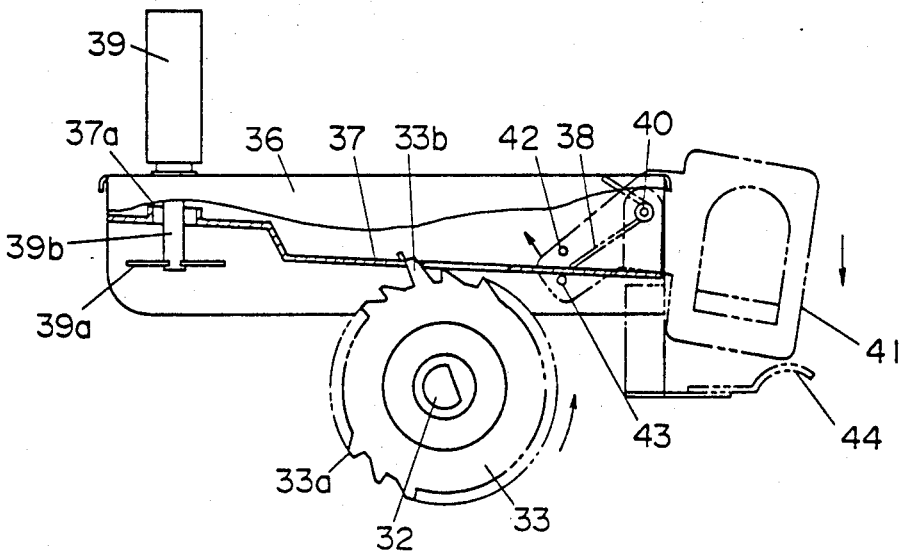
FIG. 8 is a front sectional view of the principal portion of said apparatus.

For normal fire extinguishment, as shown in FIGS. 7 and 8, the manually actuated fire extinguishing body 41 is pushed down in the arrow direction until it contacts the spring plate 44, whereupon the pin 43 is turned upward around the axis of the shaft 40 to a predetermined position to raise the lever 37, releasing the teeth 33a of the fire extinguishing gear wheel 33, so that the wick lifting shaft 32 is rotated counterclockwise by the loaded force of the fire extinguishing spring 35 until the higher tooth 33b abuts against the lever 37, whereupon it is stopped. In addition, it is possible to provide a locking piece extending downwardly from the quake fire extinguishing device so that when the locking piece is engaged by the pin 43 as the latter is raised, any further rise of the pin 43 is prevented. Then the upper end of the wick 24 is positioned to block the small holes 25a provided in the upper portion of the wick guide cylinder 25 for accelerating fire extinguishment. This is normal fire extinguishment.

At this time, since the front end of the wick 24 is set shallower (about 10–15 mm) than the outer wick guide cylinder 26 and a fire tray 25b which is the upper step portion of the wick guide cylinder 25, the upper region has air and is located close to the fire tray 25b, and since the temperatures of the outer wick guide cylinder 26 and wick guide cylinder 25 are high (about 100° C.), the evaporation from the wick 24 lasts long and hence the fire extinguishing time required is long (90–200 seconds). That is, the vapor of kerosene being continuously evaporated from the wick 24 will burn up without forming a bad odor. Since the fire at the time of extinguishment is located in the fire tray 25b, the fire does not have a sufficient amount of heat to heat the combustion cylinder, the outer wick guide cylinder 26 and wick guide cylinder 25, and the air flows into the combustion cylinder due to the draft through the wick guide cylinder 25 and the combustion chamber is quickly cooled (from maximum 700° C. to 400° C. in 1 minute and 30 seconds), so that when the fire is completely put out, the combustion chamber's temperature is below the temperature (500°–700° C.) required to decompose the kerosene (which is very small in amount) evaporated from the wick 24, and hence the odor given off during fire extinguishment is minimized.

Figure 9:
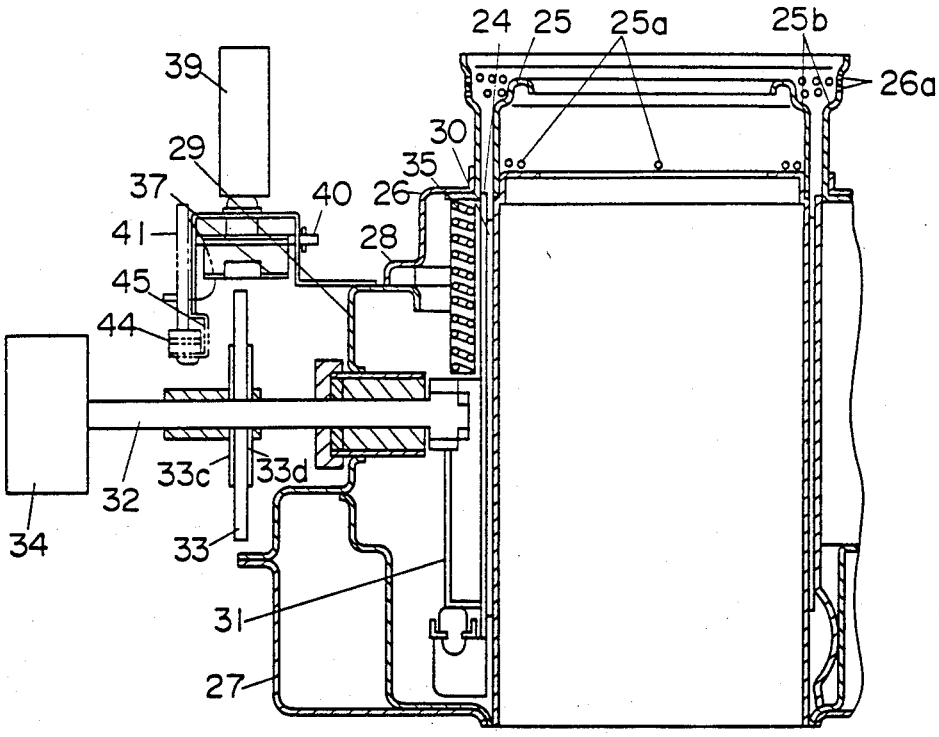
FIG. 9 is a side sectional view of the principal portion, showing the emergency fire extinguishing state.
Figure 10:
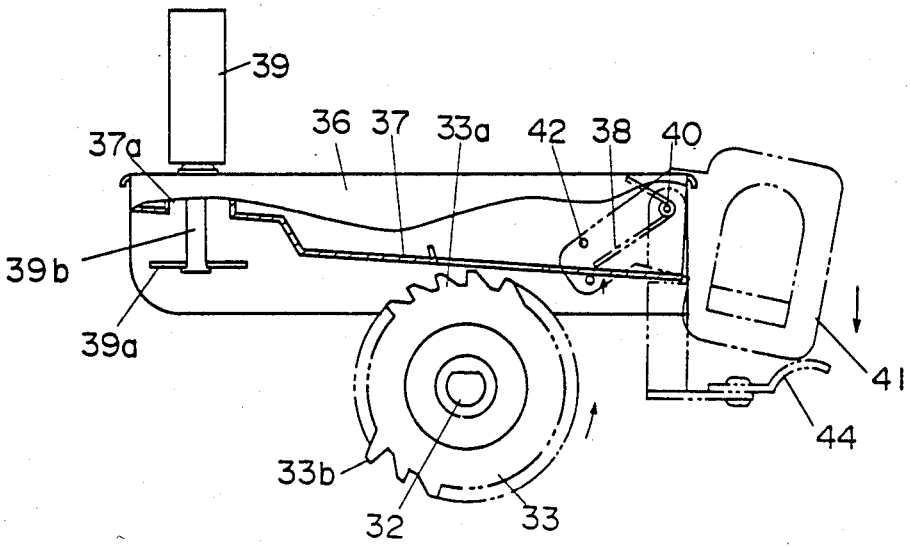
FIG. 10 is a front sectional view of the principal portion of said apparatus.

FIGS. 9 and 10 show the emergency fire extinguishing state in which the manual fire extinguishing body 41 is depressed against the force of the spring plate 44 (a pressing force of 2–3 kg). Since the pin 43 further rises to lift the lever 37, the teeth 33a and 33b of the fire extinguishing gear wheel 33 are both released from the lever 37. As a result, the wick 24 lowers with a greater stroke (20–24 mm from the fire tray 25b) than in the previously described case, and the air rapidly flows into the wick receiving section through the small holes 25a in the upper portion of the conventional wick guide cylinder 25, lowering the temperatures of the wick guide cylinder 25 and outer wick guide cylinder 26 and rarefying the vapor of kerosene from the wick 24, so that the fire can be instantaneously (within 10 seconds) put out. This is the same as the conventional instantaneous fire extinguishment and the high temperature of the combustion cylinder causes the vapor of kerosene from the extinguished wick 24 to be decomposed to give off a pungent odor, which, however, does not become a problem in an emergency.

In addition, the above embodiment has been described with reference to the arrangement having small holes 25a, which are intended to shorten the fire extinguishing time, but they are not absolutely necessary and even without them the same merits can be expected.

Figure 11:
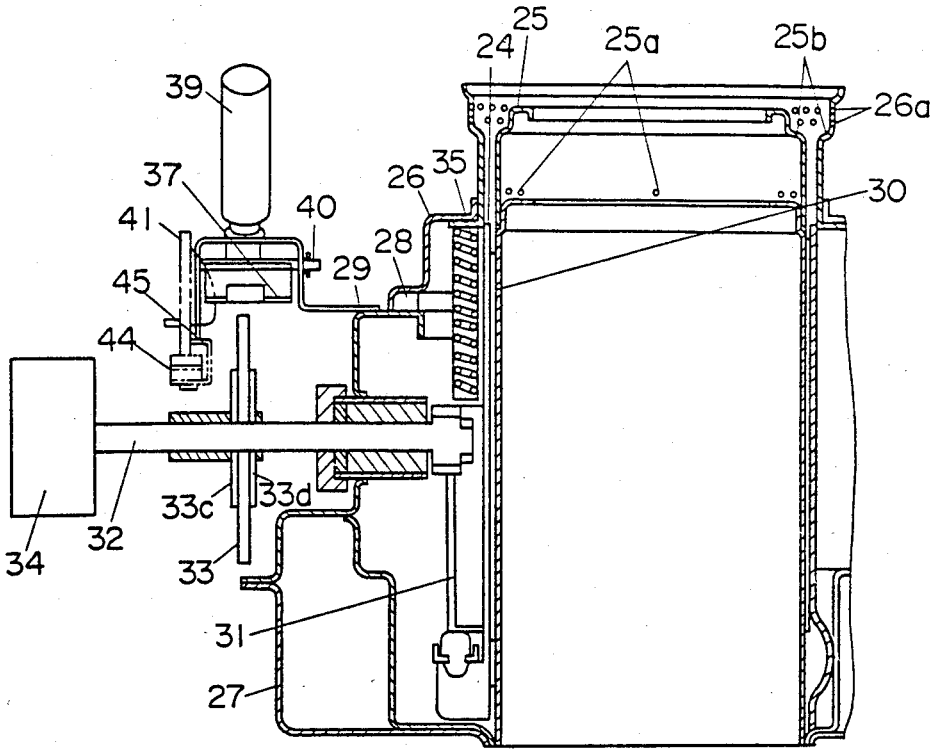
FIG. 11 is a side sectional view of the principal portion, showing the quake fire extinguishing state.
Figure 12:
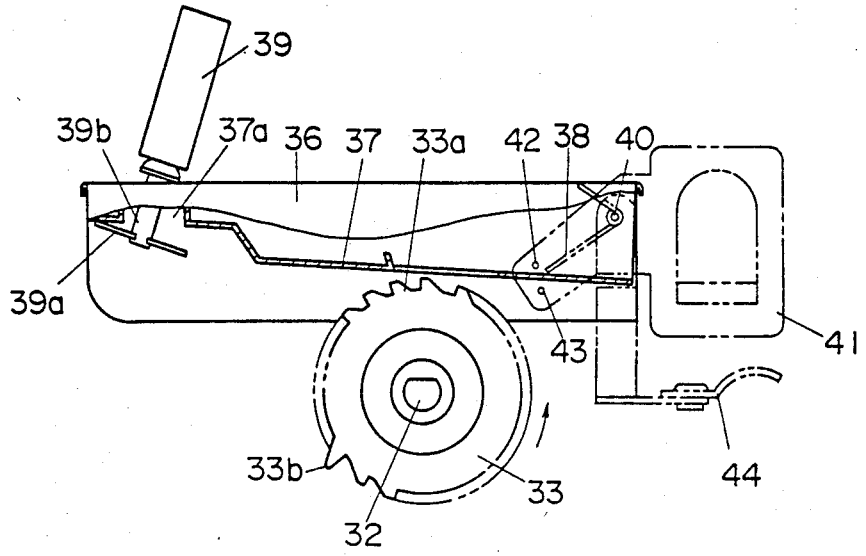
FIG. 12 is a front sectional view of the principal portion of said apparatus.

FIGS. 11 and 12 show the quake fire extinguishment during an earthquake or the like. The weight 39 of the quake sensing device is titled to cause its flange 39a to raise the lever 37 to a maximum to disengage the teeth 33a and 33b of the fire extinguishing gear wheel 33, so that the fire is put out within 10 seconds.

In addition, in the above embodiment, the spring plate 44 (which may be a coil spring) is installed below the manual fire extinguishing body 41, but it may be installed above the pin 43 so that during normal fire extinguishment the spring plate 44 comes in contact with the pin 43. This spring plate 44 is for the purpose of making it possible to extinguish the fire by the manual fire extinguishing body 41 in the same manner as in quake fire extinguishment: thus, the spring plate is intended to enable the user to feel that he is entering into an emergency fire extinguishing operation by changing the operating force on the manual fire extinguishing body 41 in the case of emergency fire extinguishment such as quake fire extinguishment and has the merit of excluding malfunction.

INDUSTRIAL APPLICABILITY

As is clear from the foregoing description of the embodiment, the present invention has the remarkable merits of being capable of extinguishing fire with ease in an at-a-touch operation by manual fire extinguishing device while giving off a minimum of odor even during at-a-touch operation using said manual fire extinguishing device, and making it possible to put out fire in a short time during emergency fire extinguishment or quake fire extinguishment.

I claim:

1. A device for extinguishing the flame of a wick in a liquid fuel burning apparatus, comprising:

a wick guide cylinder, said wick guide cylinder having a plurality of holes for accelerating fire extinguishment, said holes being located between a first wick position and a second wick position, said first wick position being above said second wick position;

a wick, said wick supported for vertical movement in said wick guide cylinder;

a wick lifting shaft operatively connected to said wick for vertically moving said wick in said wick guide cylinder by rotation of said wick lifting shaft;

a locking body mounted on said wick lifting shaft, said locking body having a first locking section and a second locking section formed around the periphery of said wick lifting shaft for stopping rotation of said wick lifting shaft at predetermined positions;

a lever adapted to engage said first locking section or said second locking section of said locking body;

spring means for urging said wick in a wick lowering direction;

manually actuated fire extinguishing means for releasing the engagement between said first locking section and said lever to permit said spring means to lower said wick by the force of said spring means down to said first wick position at which said lever engages with said second locking section; and quake responsive fire extinguishing means for releasing the engagement of said lever with both said first locking section and said second locking section to permit said spring means to lower said wick by the force of said spring means to said second wick position, said second wick position being lower than said first wick position;

whereby a bad odor is not caused when said wick is lowered to said first wick position above said plurality of holes in said wick guide cylinder during normal fire extinguishing and instantaneous fire extinguishing is achieved when said wick is lowered to said second wick position below said plurality of holes in said wick guide cylinder during emergency or quake responsive fire extinguishing.

2. The device of claim 1, wherein said manually actuated fire extinguishing means is operable to release the engagement between said second locking section and said lever.

3. The device of claim 1, further comprising spring plate means for resisting disengagement of said lever with said second locking section when said manually actuated fire extinguishing means is actuated to release engagement of said first locking section with said lever, whereby emergency fire extinguishing may be carried out by applying a force to said manually actuated fire extinguishing means which overcomes the resistance to disengagement provide by said spring plate means which thereby allows said wick to move to said second wick position below said plurality of holes in said wick guide cylinder to thereby quickly extinguish a flame burning on said wick.

4. A device for extinguishing the flame of a wick in a liquid fuel burning apparatus, comprising:

a wick guide cylinder;

a wick, said wick supported for vertical movement in said wick guide cylinder;

a wick lifting shaft operatively connected to said wick for vertically moving said wick in said wick guide cylinder by rotation of said wick lifting shaft;

a locking body mounted on said wick lifting shaft, said locking body having a first locking section and a second locking section formed around the periphery of said wick lifting shaft for stopping rotation of said wick lifting shaft at predetermined positions;

a lever adapted to engage said first locking section or said second locking section of said locking body;

spring means for urging said wick in a wick lowering direction;

manually actuated fire extinguishing means for releasing the engagement between said first locking section and said lever to permit said spring means to lower said wick by the force of said spring means down to a first wick position in said wick guide cylinder where said lever engages with said second locking section; and quake responsive fire extinguishing means for releasing the engagement of said lever with both said first locking section and said second locking section to thereby permit said spring means to lower said wick by the force of said spring means to a second wick position, said second wick position being lower than said first wick position;

whereby a bad odor is not caused when said wick is lowered to said first wick position in said wick guide cylinder during normal fire extinguishing and instantaneous fire extinguishing is achieved when said wick is lowered to said second wick position in said wick guide cylinder during emergency or quake fire extinguishing.

5. The device of claim 4, wherein said manually actuated fire extinguishing means is operable to release the engagement between said second locking section and said lever.

6. The device of claim 4, further comprising spring plate means for resisting disengagement of said lever with said second locking section when said manual fire extinguishing means is actuated to release engagement of said first locking section with said lever, whereby emergency fire extinguishing may be carried out by applying a force to said manually actuated fire extinguishing means which overcomes the resistance to disengagement provided by said spring plate means which thereby allows said wick to move to said second wick position in said wick guide cylinder to thereby quickly extinguish a flame burning on said wick.

* * * * *